United States Patent [19]

King et al.

[11] Patent Number: 4,662,513

[45] Date of Patent: May 5, 1987

[54] GARMENT BAG WITH IMPROVED PACKING CAPABILITY

[75] Inventors: William L. King, Denver; Charles K. Weisbart, Aurora, both of Colo.

[73] Assignee: Samsonite Corporation, Denver, Colo.

[21] Appl. No.: 673,351

[22] Filed: Nov. 23, 1984

[51] Int. Cl.[4] ..... A47B 61/06; B65D 85/18

[52] U.S. Cl. ..... 206/287.1; 206/287; 206/293; 206/298; 190/111

[58] Field of Search ..... 206/284, 286, 287, 287.1, 206/293, 298, 278; 190/13 R, 100, 102, 111

[56] References Cited

U.S. PATENT DOCUMENTS

| | | | |
|---|---|---|---|
| 1,150,057 | 8/1915 | O'Neill . | |
| 1,520,044 | 12/1924 | Wilt | 190/13 R |
| 1,562,417 | 11/1925 | Schuck . | |
| 1,891,025 | 12/1932 | Luttmann . | |
| 1,895,208 | 1/1933 | Salarsky . | |
| 1,913,021 | 6/1933 | Butterick . | |
| 1,914,087 | 6/1933 | Gilmore . | |
| 2,028,339 | 1/1936 | Levine et al. | 190/100 |
| 2,086,895 | 7/1937 | Cart . | |
| 2,087,211 | 7/1937 | Marbury et al. . | |
| 2,105,319 | 1/1938 | Hedden et al. . | |
| 2,176,792 | 10/1939 | Currie | 206/293 |
| 2,325,806 | 8/1943 | Simmons . | |
| 2,626,689 | 1/1953 | Davis et al. | 206/287.1 |
| 2,637,424 | 5/1953 | Duskin . | |
| 2,695,085 | 11/1953 | Ritter, Jr. . | |
| 2,740,506 | 4/1956 | Davis . | |
| 3,019,869 | 2/1962 | Engelhart . | |
| 3,115,959 | 12/1963 | Jaffe . | |
| 3,175,658 | 3/1965 | Bierman | 190/111 |
| 3,244,261 | 4/1966 | Herz | 383/21 |
| 3,512,621 | 5/1970 | Teetor | 206/287 |
| 3,542,170 | 11/1970 | Bialo . | |
| 3,737,013 | 6/1973 | Powell . | |
| 3,831,740 | 8/1974 | Pendergast et al. . | |

*Primary Examiner*—William Price
*Assistant Examiner*—Brenda J. Ehrhardt
*Attorney, Agent, or Firm*—John R. Ley

[57] ABSTRACT

A garment bag adapted to fold into a suitcase-like configuration for traveling includes corner compartments located within the interior bag in the space above the shoulders of garments supported on hangers within the bag. Cross straps extend over the shoulders of garments supported on hangers in the bag, and criss-cross over the upper portion of the garment. The cross straps support the upper portion of the garments on the hangers and restrain them against sliding downward when the bag is in the folded configuration. A stay bar is removably connected across the middle portion of the bag to support the garments when the bag is folded into the suitcase-like configuration. The ends of the straps are connected to the stay bar. A lower portion of an interior panel of the garment bag includes means for supporting the lower portions of long garments in a U-shaped configuration above a bottom gussett of the bag instead of occupying the bottom of the bag in a wrinkled bunch.

34 Claims, 5 Drawing Figures

GARMENT BAG WITH IMPROVED PACKING CAPABILITY

This invention pertains to a garment bag of the type used in traveling which is folded in half to a suitcase-like configuration. More particularly, the present invention relates to a garment bag having improvements that allow previously unused space to be used for packing items in the garment bag and to improvements which more effectively avoid the creation of wrinkles in the garments packed in the garment bag, particularly long garments.

BACKGROUND OF THE INVENTION

In garment bags of the type used in traveling, the clothes are packed in the bag when the bag is in an unfolded vertical hanging position. The clothes are suspended from hangers and the hangers are connected to a trolley within the interior of the bag. To retain the clothes in the position within the bag when it is folded into a suitcase-like configuration, a belt-like strap in the midsection of the bag is fastened around the clothes. This strap is particularly important because the clothes are bent around it and suspended from it when the bag is folded in the suitcase-like configuration. Without the center strap, the clothes would shift and slide into piles in the bottom of the bag when the bag was folded. One disadvantage of the center strap is that it has a tendency to wrinkle the clothes, particularly when it is tightened securely enough to prevent the clothes from slipping and crumpling within the bag.

Wrinkles are also frequently caused at the upper and lower ends of garments carried in the garment bag. Because the clothes are bent double when the bag is folded in its suitcase-like configuration, the tops and bottoms of the garments are at the bottom of the folded bag. The weight of the clothes tends to pull them down into bunches. A typical trolley at the upper end of the bag (which is located at the bottom when the bag is folded into the suitcase-like configuration) usually has the capability to prevent the hangers from falling off, even when the hangers become inverted after the bag is folded into the suitcase-like configuration. However, the shoulders of the garments may slip downward over the inverted hangers and wrinkling may still occur.

At the lower end of the garment bag, the clothes are usually left free. If the garment is a long one, such as a lady's dress or a long coat, the bottom part of it is usually wrinkled because it is bunched in the bottom of the bag. Even when the bag is folded, the bottoms of the long clothes still remain in bunches in the bottom of the bag.

Special hangers are usually used in garment bags in order to conserve space. The neck portion of these garment hangers is generally hinged to fold downward and thereby bring the large triangularly shaped shoulder supporting portion of the hanger up closer to the top of the bag. However, even when such hinged hangers are used, sufficient room still exists for the shoulders to work downward off of the hangers and create wrinkles. Even with such special hinged hangers, no more effective space utilization is obtained because the bottom portion of the bag is still either unoccupied or the clothes which do occupy the bottom portion of the bag are left in bunches.

One recognized approach to achieving further packing capability in a traveling garment bag has been to provide exterior pockets within which small items can be packed. When shoes or other similarly sized items are placed in these exterior pockets, the bag can become somewhat lopsided and awkward to handle in its folded configuration. Items like shoes can be placed in the interior of the bag, but since there is no method of retaining them, they are free to move about and wrinkle and dislodge the clothes.

SUMMARY OF THE INVENTION

An objective of the present invention are to provide a new and improved traveling garment bag in which garments can be packed in a more secure condition that is less susceptible for causing wrinkles. Another objective is to provide a new and improved garment bag in which certain articles like shoes can be packed to obtain better space utilization without creating an unwieldy condition when the bag is folded into the suitcase-like configuration. Still another objective is to provide a new and improved garment bag which allows long garments to be packed in a condition in which the lower portions of the garments are supported in a condition to avoid substantial wrinkling.

In accordance with one of its major aspects, the garment bag of the present invention includes a corner compartment preferably located in each upper corner of the garment bag between a top gusset and the vertically extending side gusset. A divider panel extends between the top and side gussets and separates the interior garment confining space of the bag from the interior space of the triangularly-shaped corner pocket. A flap is selectively connectable to open and close the corner pocket for access to the interior of the corner compartment. Articles like shoes can be packed in the corner compartment and confined within the interior of the bag to avoid creating a lopsided or unwieldy condition in the folded garment bag.

In accordance with another one of its major aspects, the garment bag of the present invention includes a pair of elongated cross straps adapted to cross and hold the shoulders of garments on the hangers within the bag. Each cross strap is connected within the interior of the bag at a location adjacent the shoulder of the garment on the hanger. Each cross strap extends across the shoulder of the garment diagonally across the upper portion of the garment and is selectively connectable at its other end at a location within the garment bag horizontally across and vertically below the location of the end connected adjacent the shoulder of the garment. With both cross straps connected across the shoulders of the garment, the upper portion of the garment is held and supported firmly against the hanger. The upper portions of all the garments are restrained against sliding or falling downward when the garment bag is folded into the suitcase-like configuration.

In accordance with another one of its major aspects, the present garment bag includes a stay bar operatively connected to the ends of the cross straps. The stay bar is operatively connected in the vertical mid-portion of the garment bag and extends horizontally across the garment bag. The stay bar operatively supports the folded garments when the garment bag is folded into the suitcase-like configuration. The garments curve over the stay bar without creating wrinkles. By connecting the ends of the cross straps to the stay bar, the cross straps are easily criss-crossed over the upper portion of the garment by reversing the stay bar end for end when it is connected into the garment bag.

In accordance with another of its major aspects, the garment bag of the present invention includes means for holding and supporting the lower portion of relatively long garments packed in the bag off of the bottom of the bag to avoid creating wrinkles. A lower portion of an interior panel of the garment bag includes means for retaining the lower portion of the garment thereto. When the interior panel is connected to the remaining portion of the garment bag to thereby enclose the garments within the bag, the lower portion of the relatively long garment is folded in a U-shaped configuration and is retained against the lower portion of the interior panel. In this manner, the lower portions of relatively long garments are prevented from occupying the bottom of the garment bag in a crumpled bunch.

The features and specific details of the present invention can be more completely understood by reference to the following description of the preferred embodiment taken in conjunction with the drawings, and from the appended claims.

DESCRIPTION OF PREFERRED EMBODIMENT

Figure 1:
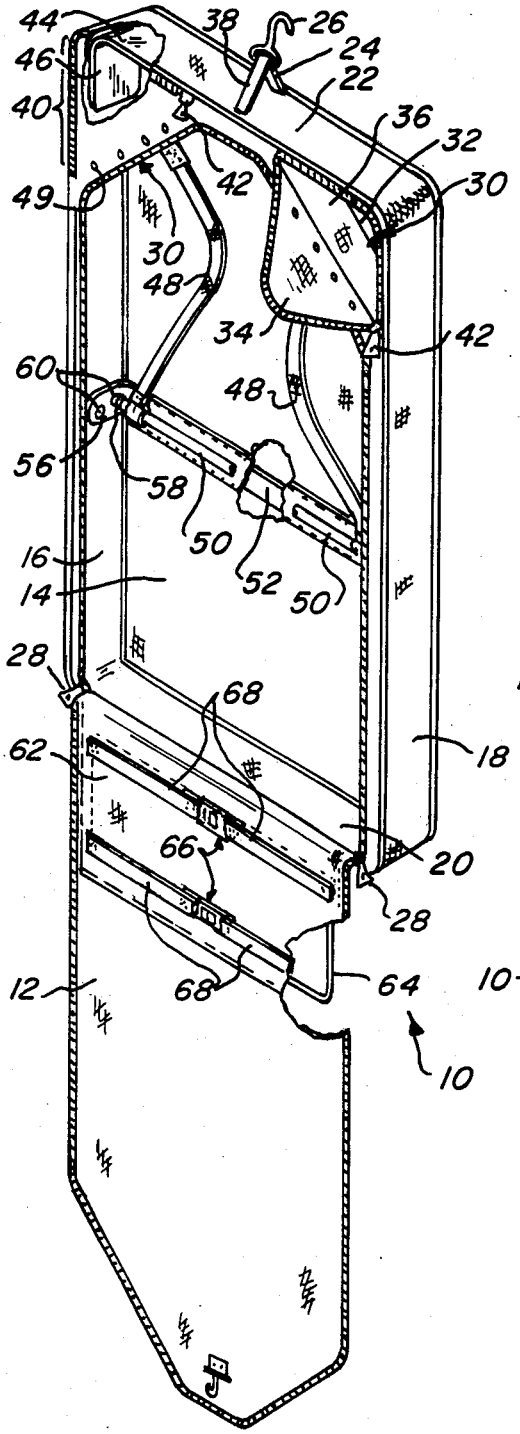
FIG. 1 is a perspective view of a garment bag of the present invention illustrated in a vertical suspended position with a front panel disconnected or unzipped from and hanging below the bag, and with an interior flap of one of two corner compartments disconnected or unzipped to reveal the interior of the corner compartment, and with other portions broken out to reveal internal elements.
Figure 5:
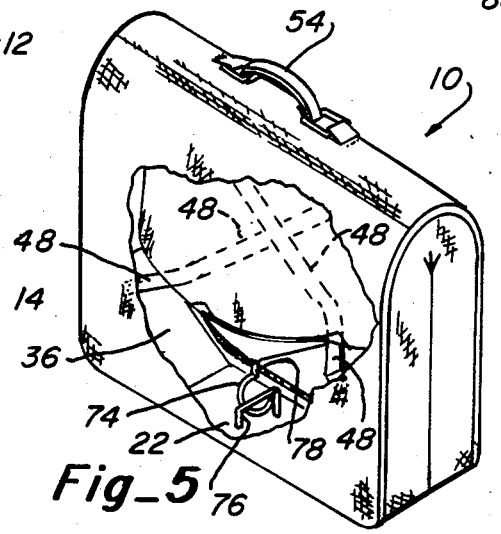
FIG. 5 is a perspective view of the garment bag shown in FIG. 4 folded into a suitcase-like configuration with a portion broken out to reveal the condition of the upper portion of the coat packed within the folded garment bag.

The garment bag 10 of the present invention is illustrated in FIG. 1 and comprises an interior panel 12, and exterior panel 14, a left and a right side gusset 16 and 18, respectively, a bottom gusset 20, and a top gusset 22. The garment bag 10 is suspended in a vertical position by an upper strap 24 and hook 26. The interior panel 12 is zipped away from the remaining portion of the bag by opening zippers 28 on opposite sides of the interior panel 12 to provide selective access into an interior space within the bag 10. As shown in FIG. 1, the side of the interior panel 12 which normally faces the interior space of the bag 10 is revealed. The features of the garment bag 10 will generally be described and claimed in relation to the manner in which it is illustrated in FIG. 1. Nevertheless, it should be understood that the top gusset 22 is actually facing downward when the garment bag is folded into the suitcase-like configuration (FIG. 5). Other than the zippers and other elements specifically mentioned herein, the garment bag 10 is constructed entirely of flexible or fabric-type material. Portions of the fabric are fastened together by sewing or other conventional techniques.

In each upper corner of the garment bag 10 there is a corner compartment 30. Each corner compartment 30 is defined by a triangular shaped corner section 32 of the exterior panel 14, a triangularly shaped interior access flap 34, an interior divider panel 36, a portion 38 of the top gusset 22 extending from an exterior corner inward to a point near the middle of the top gusset 22, and a portion 40 of the appropriate side gusset 16 or 18 extending downward from the upper corner of the bag 10 to a location where the side gusset 16 or 18 and the divider panel 36 intersect. Each corner compartment 30 approximates the configuration of a right triangle. The divider panel 36 is connected at its upper end to the top gusset 22 and at its lower end to the appropriate side gusset 16 or 18. A zipper 42 connects the interior flap 34 to the edge of the side gusset portion 40 and the top gusset portion 38. Opening or unzipping the zipper 42 opens the interior of the corner compartment 30 for access. A rigid support 44 is connected to and extends across the top gusset 22 for the purpose of providing form and support for the bag 10 in the suspended position to hold its interior open for packing as shown in FIG. 1. A flap 46 extends from the support 44 down within the interior of the corner compartment along each side gusset portion 40. The flap 46 is formed of semi-flexible material and is employed for the purpose of adding protection and strength to the corner compartments 30. Eyelets 48 are formed into the interior flap 34 for the purpose of allowing air circulation between the interior and exterior of each corner compartment 30. Each corner compartment is of sufficient size to receive therein a shoe of an average or smaller adult human (not shown).

Near the midpoint of each divider panel 36, a cross strap 48 is attached to the exterior panel 14. The outer end of each cross strap 48 is attached to an end of an elongated stay bar 50. The stay bar 50 is of rigid and preferably metallic tubular material. Each of the cross straps 48 is preferably of an elastic or longitudinally expandable material. At the vertical midpoint of the exterior panel 14 a bag support brace 52 is attached. The bag support brace 52 is of rigid material to support for the garment bag when it is folded into its suitcase-like configuration as is shown in FIG. 5. On the outer side of the exterior panel 14 as shown in FIG. 5, a carrying handle 54 is attached to the bag support brace 52.

Each end of the stay bar 50 is also operatively connected to the support brace 52 by a flexible tab 56 which extends into the interior of the bag 10 from each end of the support brace 52, as is shown in FIG. 1. At each end of the stay bar 50 a male component 58 of a conventional snap assembly is attached. A mating female component 60 of the conventional snap assembly is attached to each tab 56. Preferably, a plurality of female components 60 are attached to the tabs 56 at a plurality of locations spaced from the support brace 52. By snapping the male component 58 into the female component 60, the stay bar 50 is mechanically connected through the tabs 56 to the bag support brace 52. This mechanical connection of the stay bar 50 is important because the clothes packed in the garment bag are folded over the stay bar 50 and the stay bar 50 supports them when the garment bag is folded into the suitcase-like configuration. By providing a plurality of female snap components 60 spaced along the length of the tab 56, the stay bar 50 can be spaced from the bag support brace 52 the appropriate distance to provide a snug holding relationship according to the number of thickness of the clothes packed into the garment bag 10.

Figure 4:
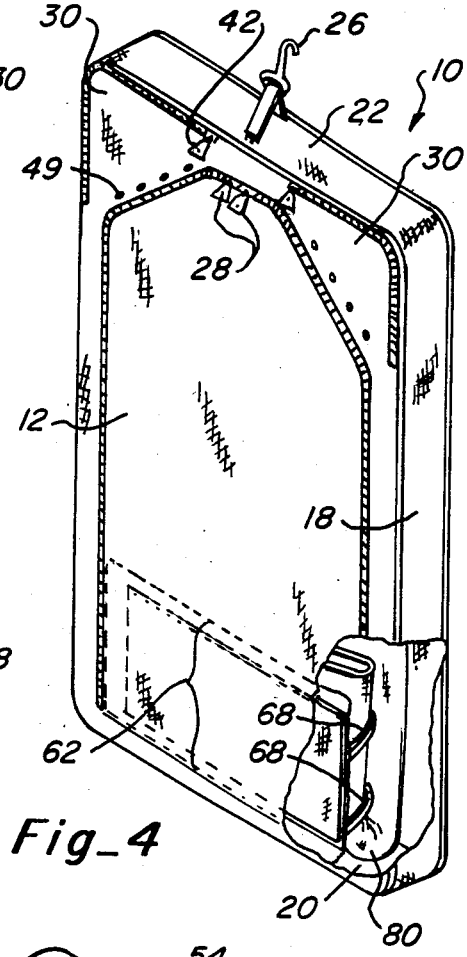
FIG. 4 is another perspective view of the garment bag shown in FIG. 3 with the interior panel zipped or connected to the bag to confine the coat within the garment bag, and with a portion broken out to reveal the condition of the lower portion of the coat packed within the garment bag.

A lower portion 62 of the interior panel 12 is permanently connected to the botton gusset 20. The lower portion 62 is so designated because it is the lower-most portion of the interior panel 12 when the interior panel is connected in the garment bag as shown in FIG. 4. A rectangular stiffening frame 64 is connected into and extends around the perimeter of the lower portion 62 to prevent the lower portion from bending. The frame 64 is preferably connected to the fabric of the lower panel 62 by sewing fabric on both sides of the frame 64. One horizontal edge of the frame 64 adjoins the edge of the botton gusset 20. The zippers 28 extend along each vertical edge of the frame 64. At two vertically spaced locations in the lower panel 62, belts 66 extend horizontally across the lower panel 62. Each of these belts includes a pair of elastic or longitudinally expandable belt straps 68 connected at the outside vertical edges of the lower panel 62. At the interior ends of each belt strap 68, a conventional buckling arrangement is provided. The stiffened lower panel 62 and the belts 66 are utilized to hold the lower portions of long garments off of the bottom gusset 22 and prevent them from wrinkling in a crumpled bunch in the bottom of the bag 10, as will be described subsequently.

Figure 2:
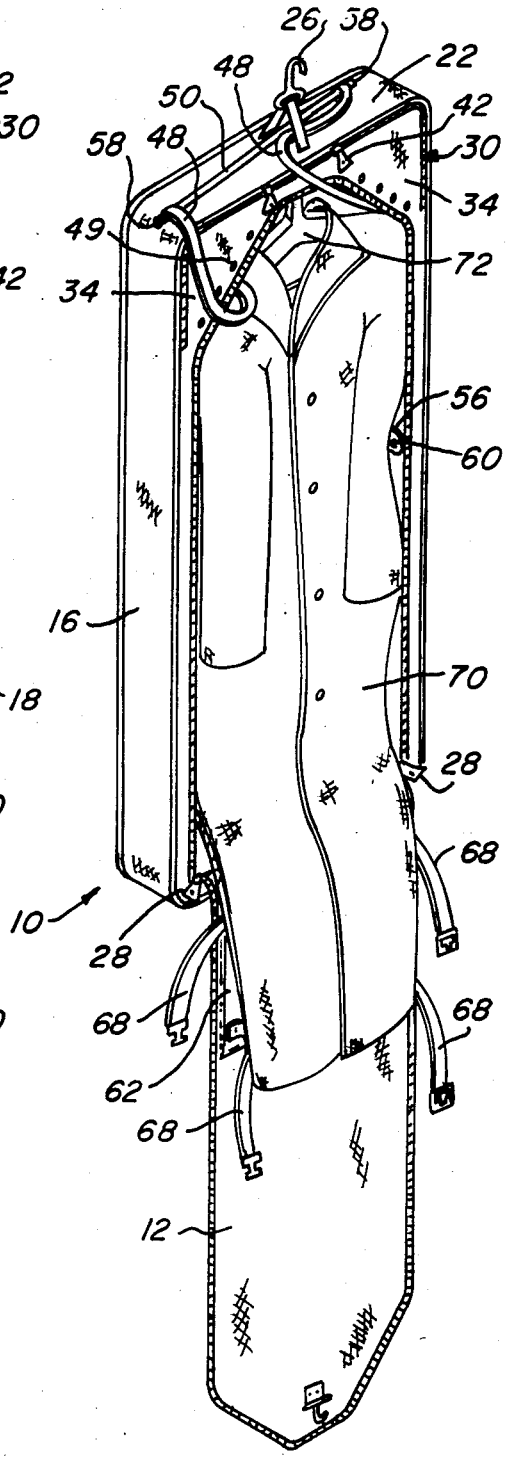
FIG. 2 is another perspective view of the garment bag shown in FIG. 1, but illustrating a stay bar and cross straps positioned above the bag, and a pair of garment connecting belts on a lower portion of the interior panel disconnected from one another, and a long coat positioned within the interior of the bag.

The garment bag 10 is packed in the manner shown in FIG. 2. The stay bar 50 is disconnected from tabs 56 and is lifted and supported above the bag 10. The stay bar 50 can be inserted into the strap 24 for convenient holding. The buckling arrangement of each of the belts 66 is disconnected and the belt straps 68 are allowed to hand free from their ends connected to the vertical edges of the lower portion 62 of the interior panel 12. With the stay bar 50 and cross straps 48 above the bag 10, the interior of the bag 10 is available for the unobstructed hanging of clothes such as the long coat 70. The clothes and coat 70 are first suspended on hangers 72. The hooked ends 74 of the garment hangers are connected in the conventional manner to a trolley 76, as shown in FIG. 5. Preferably the trolley is of the type disclosed in the co-pending invention titled Locking Trolley, Ser. No. 673,353, filed concurrently herewith and assigned to the assignee of this invention. However, other types of conventional trolleys may be used. A conventional hanger is preferred because it positions the shoulders of the garment or coat 70 at a greater distance below the top gusset 22 than is typical for most garment bag hangers. The greater length of the neck 78 of the conventional hanger provides this spacing. The corner compartments 30 are thereby of a larger or more usable size. The shoulders of the garment do not protrude into the corner compartments 30 and deform the divider panels when hangers 72 of the conventional configuration are employed.

Figure 3:
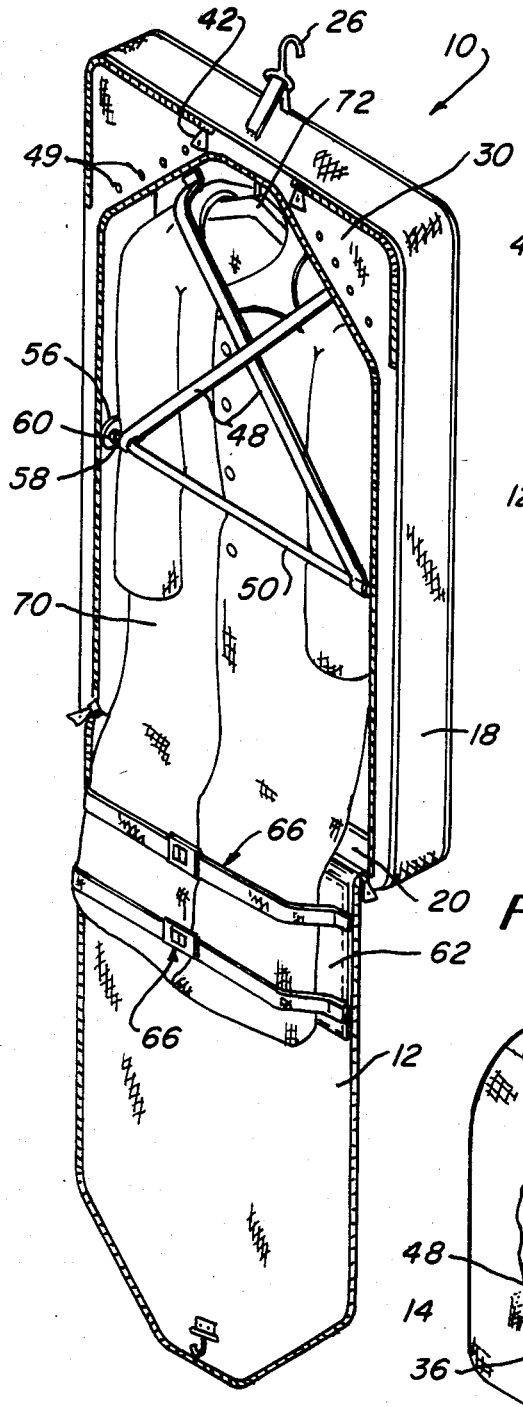
FIG. 3 is another perspective view of the garment bag and coat shown in FIG. 2, but with the stay bar and cross straps in an operative connected position across the upper portion of the coat and with the lower interior panel belts in an operative connected position across the lower portion of the coat.

After the desired number of garments such as the coat 70 have been placed into the interior of the garment bag 10 the stay bar 50 is brought back into the interior of the bag, as shown in FIG. 3. Prior to connecting the ends of the stay bar to the tabs 76, the stay bar is twisted one half of a turn end-for-end so that the cross straps 48 form an X or criss-cross over the shoulders and upper portion of the garment 70. The male snap components 58 are connected to the female snap components 60 of the tabs 56 in accordance with the thickness of the number of garments placed in the bag 10.

The cross straps 48 are pulled snuggly down on the shoulders of the coat 70 and other garments when the stay bar 50 is connected to the tabs 56. The pulling forces from the elastic cross straps 48 hold the coat 70 on the shoulder supporting portion of the hanger 72. Crossing the cross straps 48 increases the amount of elastic force applied to the shoulders of the coat 70 and also causes the pulling force to be applied approximately perpendicularly to the shoulder line of the garment on the hanger. The close adjacency of the divider panel of each corner compartment 30 also limits or restrains the amount of free space available for the coat 70 or other garment to move within the upper portion of the garment bag, particularly when the upper portion of the bag 10 is folded down. The curvature or the diameter of the stay bar 50 is also effective in preventing wrinkles in the midportion of the coat 70 or other garment because the garments fold over the curvature of the stay bar 50, as contrasted to wrinkling over sharp edges. A better resistance of wrinkles is achieved, as compared to the prior belt like center supporting straps used in prior garment bags.

The lower portion of the coat 70 or other long garment is also supported to avoid wrinkling as a result of the effect of the belts 66 on the lower panel portion 62 of the interior panel 12. The belts 66 are connected around the lower portion of the garment as shown in FIG. 3. Long garments are those whose length extends beyond the bottom gusset 20 when the garment, e.g. the coat 70, is supported on the hanger 72. The elastic of the straps 68 firmly hold the lower portion of the garment against the lower panel portion 62. When the interior panel 12 is zipped up or reconnected to the garment bag 10, as shown in FIG. 4, the lower portion of the long garment folds neatly in a U-shaped curve at the bottom portion of the bag 10. The lower-most extremity 80 of the garment is held up off of the bottom gusset 20 due to the belts 66 and the rigid supporting nature of the lower panel 62. The lower portion of the garment is not left in a crumpled bunch at the bottom of the garment bag as is typical in prior garment bags where no supporting arrangement is provided for the lower portions of long garments.

The lower portion of the long garment remains in the configuration shown in FIG. 4 when the garment bag is folded into the suitcase-like configuration. The bottom half of the garment bag remains pointing downward as is shown in FIG. 4 when the top half is folded down into the suitcase-like configuration, as shown in FIG. 5. The portions of the garments above the stay bar do, however, reverse positions and hang downward. The elastic cross straps 48 restrain the downward movement of the upper portion of the garment when the garment bag is in the suitcase-like configuration. When the hooked end(s) 76 of the hangers are locked to a locking trolley, the hanger becomes a substantial support upon which the cross straps hold the garments. When the corner compartments are packed with articles such as shoes, the divider panels 36 provide further support for preventing the garments from slipping downward off of the triangular shaped shoulder supporting portions of the hangers.

As is apparent from the foregoing description, the garment bag 10 of the present invention provides significantly improved capabilities for packing garments and other articles within its interior. The corner compartments 30 are available for packing items such as shoes which would otherwise have to be packed loose within the interior of the bag or which would have to be packed in an exterior pocket of the garment bag. If packed within the interior of the bag, the shoes or other articles would undoubtedly cause wrinkles in the clothes as they moved about. If packed in exterior pockets, the articles cause the folded garment bag to assume a lopsided and unwieldly configuration for carrying. The stay bar has the effect of providing a smooth curved surface over which the clothes are bent and suspended, but which reduces the possibility for creating wrinkles due to the curvature of the stay bar. The elastic cross straps more effectively hold the upper portion of the garments firmly against the inverted hangers when the garment bag is in its folded suitcase-like configuration to restrain the upper portions of the garments from sliding downward. The corner compartments when packed also aid in holding the garments on the hangers. The lower portions of long garments are neatly curved upward in a wrinkle resistant manner at the bottom of the bag, rather than existing in a crumpled heap at the bottom of the bag as is typical in prior garment bags. Numerous other advantages are inherent from the improved aspects of the present invention.

The nature and operation of the present invention has been shown and described with a degree of specificity. It should be understood, however, that the specificity of the description has been made by way of preferred example and that the invention is defined by the scope of the appended claims.

What is claimed is:

1. An improved garment bag of the type adapted to fold into a suitcase-like configuration for traveling and having an interior space within which to pack garments, the interior space formed essentially by an exterior panel, a left and a right vertical side gusset, a top gusset, a bottom gusset, and an interior panel flexibly connected to the bottom gusset and selectively removably connected to the top and side gussets, said garment bag including improvements in combination therewith comprising:

at least one corner compartment located at the upper corner of the garment bag and formed essentially by a divider panel connected to the exterior panel and extending between a side gusset and a middle location on the top gusset, and by an access flap which is operatively connected to the divider panel and to the portions of the side and top gussets between the ends of the divider panel and the corner of the bag at which the corner compartment is located;

an elongated stay bar having an exterior surface for supporting garments folded thereover;

means within the interior space of the bag for retaining the stay bar at a location with each end thereof generally adjacent the vertical gussets with the stay bar generally positioned in a horizontal orientation spaced approximately midway between the top and bottom gussets;

a pair of expandable cross straps, each cross strap connected at one end to the stay bar and connected at the other end at a location adjacent the divider panel; and garment holding means connected to a lower portion of the interior panel and operative at a surface of the lower portion of the interior panel facing the interior space when the interior panel is selectively connected to the side and top gussets, the garment holding means operative for holding and supporting the lower portions of garments packed in the bag.

2. An improved garment bag as defined in claim 1 further comprising:

means for stiffening the lower portion of the interior panel against bending.

3. An improved garment bag as defined in claim 1 wherein the interior panel is also selectively removably connected to and along the divider panel.

4. An improved garment bag as defined in claim 1 further comprising a pair of corner compartments, each located in an opposite upper corner of the garment bag.

5. An improved garment bag as defined in claim 3 wherein at least one of the elements of the corner compartment includes means for allowing air to circulate between the interior and the exterior of the corner compartment.

6. An improved garment bag as defined in claim 1 wherein the garment bag further includes a bag supporting means connected to the exterior panel at a vertical location approximately midway between the top and bottom gussets and extending horizontally between opposite side gussets, the bag supporting means adapted to support the bag when folded into the suitcase-like configuration, and wherein said improvement further in combination therewith:

said means for retaining the stay bar further comprises a retaining tab connected to the bag supporting means and extending into the interior space at a location adjacent a side gusset, the tab further including means connected thereto for selectively connecting an end of the stay bar to the tab.

7. An improved garment bag as defined in claim 6, further comprising a pair of said tabs, each tab located adjacent an opposite side gusset, and wherein the means for selectively connecting an end of the stay bar to the tab is further operative to connect the end of the stay bar at a selected one of a plurality of different locations spaced from the exterior panel.

8. An improved garment bag as defined in claim 7 wherein the length of the cross straps is sufficient to criss-cross the straps when connecting the stay bar to the tabs.

9. An improved garment bag as defined in claim 2 wherein the stiffening means comprises a frame member extending generally around the perimeter of the lower interior panel.

10. An improved garment bag as defined in claim 9 wherein the garment holding means comprises at least one belt extending horizontally across the lower portion of the interior panel.

11. An improved garment bag as defined in claim 6 further comprising means for stiffening the lower portion of the interior panel against bending, wherein the stiffening means comprises a frame member extending generally around the perimeter of the lower interior panel, and the garment holding means comprises at least one belt extending horizontally across the lower portion of the interior panel.

12. An improved garment bag as defined in claim 11 further comprising a pair of tabs, each tab located adjacent an opposite gusset, each tab including means for selectively connecting an end of the stay bar thereto at a selected one of a plurality of different locations spaced away from the exterior panel, and wherein the length of each cross strap is sufficient to criss-cross the straps when connecting the stay bar to the tabs.

13. An improved garment bag is defined in claim 12, further comprising a pair of corner compartments, each located in an opposite upper corner of the garment bag.

14. An improved garment is defined in claim 13 wherein each selectively removable connection of the interior panel is achieved by means of a zipper, and wherein each access flap of each corner compartment has a portion which is selectively removably connected to at least one other element of the garment bag by means of a zipper.

15. An improved garment bag of the type adapted to fold into a suitcase-like configuration for traveling and having an interior space within which to pack garments, the interior space formed essentially by an exterior panel, a left and a right vertical side gusset, a top gusset, a bottom gusset, and an interior panel operatively connected to said gussets and including means for providing selective access into the interior space, the garment bag further including means for operatively retaining hangers from a generally center location at the top gusset and further including bag supporting means connected to the exterior panel at a vertical location generally midway between the top and bottom gussets and extending horizontally between the side gussets, the bag supporting means adapted to support the bag when folded into the suitcase-like configuration, and improvements in combination therewith comprising:

an elongated stay bar having an exterior surface for supporting garments folded thereover;

means within the interior space of the garment bag for retaining the stay bar in a horizontal orientation spaced outward from the bag supporting means; and a pair of cross straps, each cross strap connected at one end to the stay bar and connected at the other end to the garment bag at a location to be adjacent the shoulder of a garment supported on a hanger connected to the hanger end connection means, the length of the cross straps is sufficient to criss-cross the straps when retaining the stay bar within the garment bag.

16. An improved garment bag as defined in claim 15 further comprising:

means for retaining the stay bar at a selected one of a plurality of locations each spaced a different distance from the bag supporting means.

17. An improved garment bag as defined in claim 16 wherein said means for retaining the stay bar further comprises a pair of tabs connected to the bag supporting means and extending into the interior space at locations adjacent each opposite side gusset, each tab including means for selectively connecting an end of the stay bar to the tab.

18. An improved garment bag as defined in claim 17 wherein each tab includes means for selectively connecting an end of the stay bar at a selected one of a plurality of locations each spaced a different distance away from the bag supporting means.

19. An improved garment bag as defined in claim 16 further comprising:

garment holding means connected to a lower portion of the interior panel and operative at a surface of the lower portion of the interior panel facing the interior space when the interior panel is selectively connected to the side and top gussets, said garment holding means operative for holding and supporting the lower portions of garments packed in the bag.

20. An improved garment bag as defined in claim 19 wherein the interior panel is flexibly connected to the bottom gusset and selectively removably connected to the top and side gussets, and further comprising:

means associated with a lower portion of the interior panel for stiffening the lower portion of the interior panel against bending.

21. An improved garment bag as defined in claim 20 wherein the stiffening means comprises a frame member extending generally around the perimeter of the lower portion of the interior panel, and the garment holding means comprises at least one belt extending horizontally across the lower portion of the interior panel.

22. An improved garment bag of the type adapted to fold into a suitcase-like configuration for traveling and having an interior space within which to pack garments, the interior space formed essentially by an exterior panel, a left and a right vertical side gusset, a top gusset, a bottom gusset, and an interior panel operatively connected to said gussets and including means for providing selective access into the interior space, said garment bag further including means for operatively retaining hangers supporting garments from a generally center location at the top gusset, and an improvement in combination therewith comprising:

at least one elongated cross strap within the interior of the bag, each cross strap connected at one end to a location within the bag adjacent the shoulder of a garment supported on a hanger retained by said hanger retaining means, each cross strap operatively connectable at the other end thereof to a location within the interior of the bag on the opposite horizontal side of the bag and below the one end of the strap, each cross strap when connected at both ends extending over one shoulder of a garment in the bag supported on a hanger retained by said hanger retaining means and further extending diagonally across and down the upper portion of the garment.

23. An improved garment bag as defined in claim 22 wherein the other end of each cross strap is connected adjacent the opposite vertical side gusset at a vertical location approximately midway between the top gusset and the bottom gusset.

24. An improved garment bag as defined in claim 23 further comprising a pair of said cross straps, the pair of cross straps criss-crossing one another over the upper portion of the garment.

25. An improved garment bag as defined in claim 24 wherein the bag includes a bag supporting means connected to the exterior panel at a vertical location generally midway between the top and bottom gussets and extending horizontally between the opposite side gussets, the bag supporting means adapted to support the bag when folded into the suitcase-like configuration, and wherein said improvement further comprises in combination therewith:

an elongated stay bar, the other end of each cross strap connected to the stay bar at opposite ends of the stay bar; and means for retaining the stay bar within the interior space of the garment bag in a generally horizontal orientation spaced from the bag supporting means and at a vertical location approximately midway between the top and bottom gussets.

26. An improved garment bag as defined in claim 25 further comprising:

garment holding means connected to a lower portion of the interior panel and operative at a surface of the lower portion of the interior panel facing the interior space when the interior panel is selectively connected to the side and top gussets, said garment holding means operative for supporting and holding the lower portions of garments packed into the bag.

27. An improved garment bag as defined in claim 26 wherein the interior panel is flexibly connected to the bottom gusset and selectively removably connected to the top and side gussets, and further comprising:

means associated with a lower portion of the interior panel for stiffening the lower portion of the interior panel against bending.

28. An improved garment bag of the type adapted to fold into a suitcase-like configuration for traveling and having an interior space within which to pack garments, the interior space formed essentially by an exterior panel, a left and a right vertical side gusset, a top gusset, a bottom gusset, and an interior panel operatively connected to said gussets and including means for providing selective access into the interior space, said garment bag including an improvement in combination therewith comprising:

at least one corner compartment located at the upper corner of the garment bag and formed essentially by a divider panel connected to the exterior panel and extending between a side gusset and a middle location on the top gusset, and an access flap which is connected to the divider panel and the portions of the side and top gussets between the ends of the divider panel and the corner of the bag at which the corner compartment is located, and wherein:

the interior panel is also selectively removably connectable to the divider panel along the divider panel between the side and top gussets.

29. An improved garment bag as defined in claim 28 wherein the access flap is selectively removably connected along an outer edge thereof to edges of the portions of the side and top gussets between the location where the divider panel intersects the side and top gussets.

30. An improved garment bag as defined in claim 28 wherein the size of the corner compartment is sufficient to accept therein a shoe of an average or smaller adult human without substantially distorting the corner compartment.

31. An improved garment bag as defined in claim 28 wherein the divider panel extends substantially straight and creates a corner compartment of a substantially triangularly shaped configuration.

32. An improved garment bag as defined in claim 28 further comprising a pair of corner compartments, each located in an opposite upper corner of the garment bag.

33. An improved garment bag as defined in claim 28 wherein at least one of the elements of the corner compartment includes means for allowing air to circulate between the exterior and the interior of the corner compartment.

34. An improved garment bag as defined in claim 28 wherein each selectively removable connection of the interior panel and each access flap is achieved by means of a zipper.

* * * * *